US006702634B2

(12) United States Patent
Jung

(10) Patent No.: US 6,702,634 B2
(45) Date of Patent: Mar. 9, 2004

(54) MOTORIZED SURFBOARD DEVICE

(76) Inventor: Koock Elan Jung, 594 Bay Rd., Queensbury, NY (US) 12804

( * ) Notice: Subject to any disclaimer, the term of this patent is extended or adjusted under 35 U.S.C. 154(b) by 0 days.

(21) Appl. No.: 09/924,019

(22) Filed: Aug. 7, 2001

(65) Prior Publication Data

US 2002/0072285 A1 Jun. 13, 2002

Related U.S. Application Data

(63) Continuation-in-part of application No. 09/716,315, filed on Nov. 20, 2000, now abandoned.

(51) Int. Cl.[7] ..... B63B 35/73
(52) U.S. Cl. ..... 441/74; 440/38
(58) Field of Search ..... 440/38, 48; 114/55.56; 441/74, 65; 416/176, 177

(56) References Cited

U.S. PATENT DOCUMENTS 1,448,080 A * 3/1923 Noeggerath ..... 416/176
3,426,721 A * 2/1969 Justinien ..... 440/48
3,548,778 A 12/1970 Van Smagla
4,020,782 A 5/1977 Gleason
4,321,048 A 3/1982 Marchese
4,350,113 A * 9/1982 Moreau et al. ..... 114/55.56
5,017,166 A 5/1991 Chang
6,192,817 B1 * 2/2001 Dec et al. ..... 114/55.56

* cited by examiner

*Primary Examiner*—Ed Swinehart

(57) ABSTRACT

A motorized surfboard device can be ridden by a rider comprises a surfboard having an underside surface and a top side surface. The motorized surfboard device also includes a motive device mounted on the underside surface of the surfboard. The motive device comprises a motor and a rotatable propeller, in which the motor is connected to the rotatable propeller for rotating the same. The propeller comprises a cylindrical body with a surface configuration including at least one groove in a surface of the rotatable propeller body, wherein the at least one grove defines raised ridges between the at least one groove, the edges of the grooves being rounded, the at least one comprising a depth. The motorized surfboard device including a control apparatus having at least one of a foot-controlled switch, a hand-operated and controlled steering column, and a hand controlled switch. The control apparatus controlling at least one of on/off operation of the motor and variable speed of the motor.

20 Claims, 3 Drawing Sheets

FIG. 1
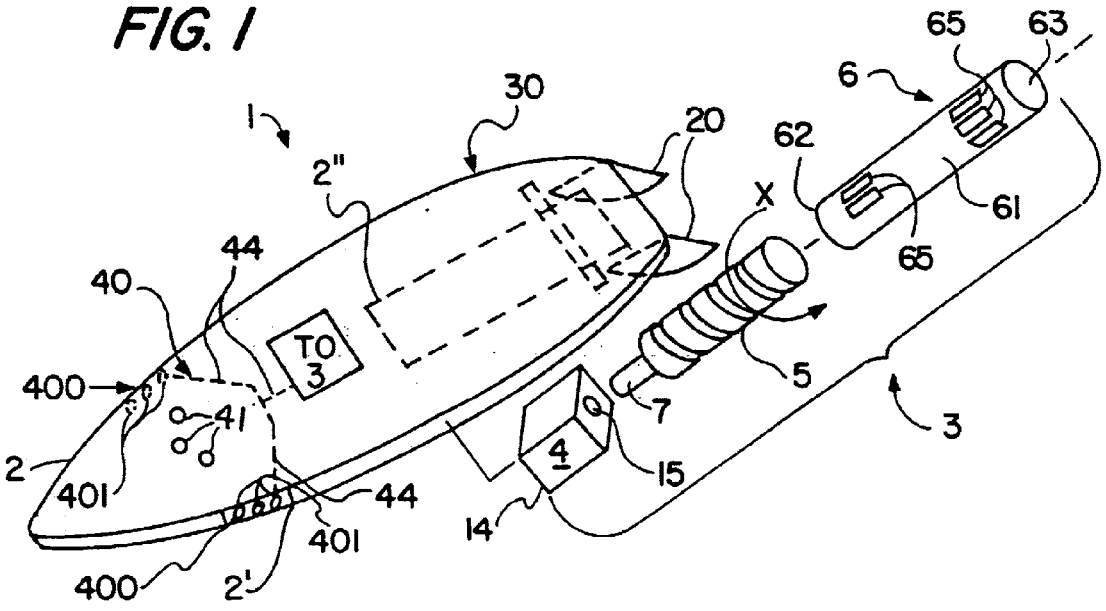
FIG. 2
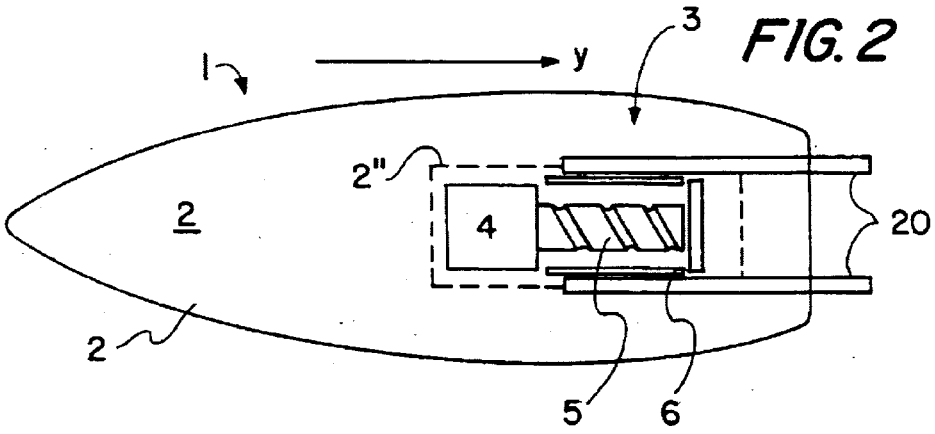
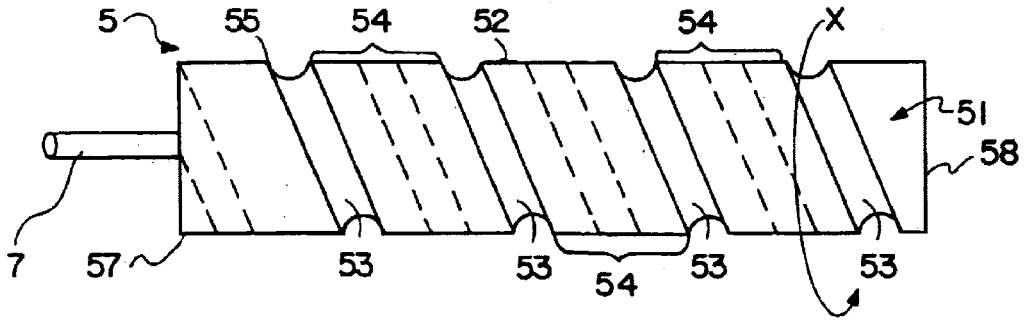
FIG. 3

MOTORIZED SURFBOARD DEVICE

This application is a Continuation-in-Part of U.S. Ser. No. 09/716,315, filed Nov. 20, 2000 now abandoned. The entire contents of U.S. Ser. No. 09/716,315 filed Jan. 20, 2000 are fully incorporated herein.

BACKGROUND OF THE INVENTION

The invention relates to a surfboard. In particular, the invention relates to a motorized surfboard device.

Surfing is the sport of riding a surfboard on the crest of a wave to move toward shore. Therefore, the sport of surfing can only be played in seaside, or where sea wave or artificial sea wave is available. Most surfboards do not provide a surfboard, which can be used for playing the sport of surfing on smooth water surface.

The disadvantages of non-motorized surfboards are well known. Thus, although surfboard riding is mainly a popular sport only along coastal regions, where the surfboard may be driven towards the shore by manipulation of the board along the crests of the waves. Surfboard riding generally has little utility on lakes or even along coastal areas during periods when there is no wave promulgation.

The use of motorized surfboards has been known heretofore. However, the construction of such surfboards, in order to accommodate the motors, has often been complex and expensive and frequently has required such structural modification of the surfboard as to adversely influence the flotation characteristics of the board when in use without the motor. For example, U.S. Pat. No. 3,548,778 to Von Smagala-Romanoff, U.S. Pat. No. 4,020,782 to Gleason, and U.S. Pat. No. 5,017,166 to Chang disclose powered motorized surfboards of propelling a user. However, these surfboards do not include a motive device with a propeller that reduces possibilities of injuries to the user if the user should fall off the surfboard. Further, the surfboards of Von Smagala-Romanoff and Gleason do not provide a guard or other structure to protect a user from being injured by the propeller of the motive device, in which the motive device that reduces possibilities of injuries to the user if the user should fall off the surfboard.

Further, these above-discussed patents and others known do not include means to prevent the motorized surfboard from traveling away from a fallen user of the motorized surfboard. While a motor of these motorized surfboards may turn off when a user falls off the surfboard, the surfboard itself may have sufficient momentum to travel far away from the user. The typical cord attached to a user's ankle will not be adequate for these purposes, even with a motor turning off, as the cord can get caught up in the motive device of the motorized surfboard, which, of course, is unsatisfactory. Moreover, if the motor of the motorized surfboard does not turn off while using a cord, the user may be dragged behind the motorized surfboard. This situation could be very dangerous.

Therefore, a need exists for a motorized surfboard device, in which safety of the user is addressed. Also, a need exists for a motorized surfboard device with means to prevent a motorized surfboard from traveling away from the user, if the user falls off of the surfboard.

SUMMARY OF THE INVENTION

Accordingly, it is desirable to provide a motorized surfboard device can be ridden by a rider comprises a surfboard having an underside surface and a top side surface. The motorized surfboard device also includes a motive device mounted on the underside surface of the surfboard. The motive device comprises a motor and a rotatable propeller, in which the motor is connected to the rotatable propeller for rotating the same. The propeller comprises a cylindrical body with a surface configuration including at least one groove in a surface of the rotatable propeller body, wherein the at least one grove defines raised ridges between the at least one groove, the edges of the grooves being rounded, the at least one comprising a depth. The motorized surfboard device including a control apparatus having at least one of a foot-controlled switch, a hand-operated and controlled steering column, and a hand controlled switch. The control apparatus controlling at least one of on/off operation of the motor and variable speed of the motor.

These and other aspects, advantages and salient features of the invention will become apparent from the following detailed description, which, when taken in conjunction with the annexed drawings, where like parts are designated by like reference characters throughout the drawings, disclose embodiments of the invention.

BRIEF DESCRIPTION OF THE DRAWINGS

FIG. 1 is a schematic and exploded illustration of a motorized surfboard device, as embodied by the invention;

FIG. 2 is a bottom view of a motorized surfboard device, as embodied by the invention;

FIG. 3 is a close up view of the screw propeller for the motorized surfboard device, as embodied by the invention;

DETAILED DESCRIPTION OF THE INVENTION

Figure 4:
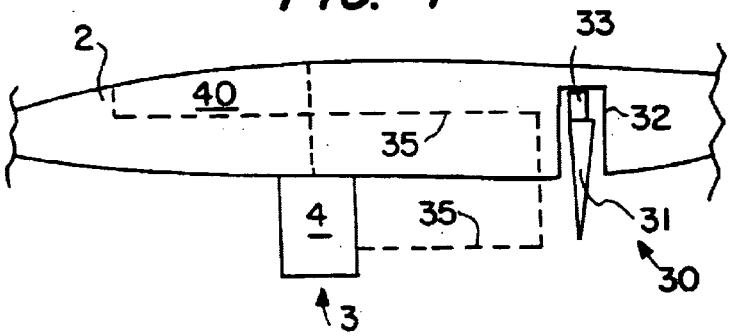
FIG. 4 is a close-up view of a guard rail structure for a motorized surfboard device, as embodied by the invention.

The invention, as set forth herein, provides a motorized surfboard device 1. The motorized surfboard device 1 comprises a surfboard 2 and a motive device 3. The motive device 3 can comprise a device that can propel the surfboard 2 and its user. The motive device 3 will comprise any appropriate motive device 3, as described hereinafter.

The surfboard 2, as embodied by the invention, comprises a typical surfboard construction, as known by those of skill in the art. The surfboard 2 of the motorized surfboard device 1 can be formed of any conventional material, by those practices known in the art. Accordingly, details to the surfboard 1, as embodied by the invention, will not be provided, as they are well within the skill of those in the art.

The motive device 3 of the motorized surfboard device 1, as embodied by the invention, provides sufficient forces to propel the surfboard 1 with a rider (user) thereon. The motive device 3 provides sufficient forces to propel the surfboard 1 with a rider thereon in the absence of waves. The calm water may be "non-wavy" water, for example in generally calm water, such as, but not limited to, water in lakes, ponds, tidal basins, rivers, and other such bodies of water. Further, the motive device 3 provides sufficient forces to propel the surfboard 1 with a rider in calm ocean water, including ocean waters at low tide, oceans' waters without waves that would normally permit a rider to surf, and other ocean conditions that do not generally permit surfing.

Furthermore, the motive device 3 of the motorized surfboard device 1, as embodied by the invention, can be used as a learning system for beginning surfers. A beginning surfer, one who is not a proficient surfer, can become accustomed to surfing on a surfboard 2, which are not generally possible. Typically, a beginning surfer has to start their surfing learning at low wave conditions, however, these conditions may not always be available at most surfing beaches. By using the motorized surfboard device 1, as embodied by the invention, a beginning surfer may become accustomed to riding on the surfboard 2, in generally calm waters, at which the rider is untroubled by trying to find "learning" waves at surfing spots. Thus, the beginning surfer can gain confidence in reactively calm and comfortable conditions, and then be able to progress to heavier wave conditions with enhanced levels of surfing experience.

The motive device 3, as embodied by the invention, comprises at least a motor 4, a propeller apparatus 5 (hereinafter "propeller"), and a guard 6, all of which will be described in further detail hereinafter. The motor 4, propeller 5, and guard 6, as embodied by the invention, are operatively connected by transmission elements, including, but not limited to, connecting rod 7 that transmits forces from the motor 4 to the propeller 5 to rotate the propeller 5 and cause movement of the motorized surfboard device 1.

The motive device 3 of the motorized surfboard device 1, as embodied by the invention, comprises a motive device 3 with a motor 4 that provides sufficient forces to drive the propeller 5 and move the motorized surfboard device 1 with a rider thereon. The motor 4 is mounted to an underside surface 2' of the surfboard 2 (FIGS. 1 and 2), in which the underside surface is opposed to the top surface of the surfboard 2. The motive device 3 inclusive of the motor 4 can be mounted flush to the underside 2' of the surfboard 2. Alternatively, the comprise a motive device 3 inclusive of the motor 4 can be mounted in a depression 2" in the underside 2' of the surfboard 2. Thus, the motive device 3 inclusive of the motor 4 can be mounted in contact with water on which the surfboard 2 and motorized surfboard device 1 is to be used.

The motor 4 of the motive device 3 is encased in a watertight casing 14. The water-tight casing 14 seals the motor 4 from contact with water, which may cause damage to the motor 4. The water-tight casing 14 includes an opening 15 with a water-tight gasket (not illustrated for ease of illustration) through which the connecting rod 7 extends. The connecting rod 7 extends through the opening 15 in a sealed fashion to seal and protect the motor 4 from contact with water.

The motor 4 of the motive device 3 for the motorized surfboard device 1, as embodied by the invention, can comprise any appropriate form of motor 4 that is able to drive the propeller 5. For example, the motor 4 of the motive device 3 can comprise, but is not limited to, at least one of an electric motor (that can be recharged), a motor device, a gas-driven motor, and combinations thereof (also known as "hybrid" motors). If the motor 4 comprises an electric motor, the motor 4 can comprise a DC motor with a DC power supply, and the DC power supply may be recharged. These types of motors 4 are merely exemplary of the motors within the scope of the invention, and should not be construed as limiting of the invention in any manner. The motor 4 of the motive device 3 in the motorized surfboard device 1, as embodied by the invention, can comprise, but is not limited to, a variable speed motor.

The propeller 5 of the motive device 3 of the motorized surfboard device 1, as embodied by the invention, is illustrated in FIGS. 1 and 3 and in further detail in FIG. 3). The propeller 5 of the motorized surfboard device 1 comprises a structure that is believed to be less hazardous than conventional screw-type propellers. As illustrated in FIG. 3, the propeller 5, as embodied by the invention, comprises a cylindrical body 51 with a surface configuration that, when rotated in the direction of arrow X (FIG. 1) moves water with respect to the surfboard 2. Thus, the propeller 5 of the motive device 3 of the motorized surfboard device 1, as embodied by the invention, provides a motive force to move the surfboard 2 and rider on the water.

The propeller 5 (FIG. 3) comprises the generally cylindrical body 51, which can be formed from any appropriate material, such as, but not limited to, metals, plastics, composites, and other such materials. The surface 52 of the cylindrical body 51 comprises at least one groove 53, and can comprise a series of grooves 53. Each groove 53 extends along the cylindrical body 51. The grooves 53 in FIG. 3 are illustrated with one groove in dashed lines (phantom) and one groove in solid lines. The grooves 53 define raised ridges 54 between the grooves 53. The edges 55 of the grooves 53 are rounded and do not present sharp edges or contours that could harm a rider if a rider contacts them, in direct contrast to a screw propeller, as is known in the art. The edges 55 of the propeller can be rounded to further enhance safety if there is inadvertent contact by a rider with the propeller 5.

The grooves 53 of the propeller 5 can be formed with any appropriate depth in the body 51 so as to provide movement of the motorized surfboard device 1. The depth of the grooves 53 in the body 51 may be varied, for example provided with a shallower groove depth will move lesser amounts of water, and thus move the motorized surfboard device 1 at a slower speed. Conversely, a deeper groove depth of the grooves 53 can be provided will move will move higher amounts of water, and thus move the motorized surfboard device 1 at a speed faster than that compared to shallower depths. While the propeller 5 illustrated in FIG. 3 illustrates a one depth for the grooves 53, this depth is merely exemplary of the depths of grooves 53 for the propeller 5 of the motorized surfboard device 1, as embodied by the invention. Other depths for the grooves 53 are well within the scope of the invention.

Accordingly, the propeller 5 of the motorized surfboard device 1, as embodied by the invention, comprises a series of grooves 53 and raised ridges 54. This structure, when the propeller 5 is rotated by the motor 4 of the motorized surfboard device 1, as embodied by the invention, can move water down the surfboard 2 in the general direction of arrow Y with respect to the motive device 3. The water can be generally seen as moved in the grooves 53 down the propeller 5 as the propeller 5 rotates. The water can move within the grooves 53 from a front portion 57 to a rear portion 58 of the propeller 5, as known by those of ordinary skill in the fluid propulsion arts. Thus, by the basic principles of fluid dynamics, the propeller 5, as embodied by the invention, provides sufficient motive forces to the motorized surfboard device 1 to move the motorized surfboard device 1 and a rider on water to simulate surfing.

The motive device 3 of the motorized surfboard device 1, as embodied by the invention, may also comprise a guard 6 (FIGS. 1 and 2), however the guard 6 for the motorized surfboard device 1 is not required for the motorized surfboard device 1, as embodied by the invention. The guard 6, as embodied by the invention, can encircle at least a portion of the propeller 5 to cover the propeller 5. The guard 6 permits water to contact the propeller 5 while protecting the rider from inadvertent contact with the propeller 5.

The guard 6, as embodied by the invention and illustrated in FIGS. 1 and 2, comprises a generally cylindrical body 61 that is open at both ends 62 and 63. The cylindrical body 61 also comprises at least one, and as illustrated a plurality of apertures 65 along the cylindrical body 61. The apertures 65 are disposed along the cylindrical body 61 so that water may enter and exit the cylindrical body 61 by virtue of the rotation of the propeller 5. For example, and in no way limiting of the invention, water may be "pulled" into the grooves 53 of the propeller 5 through the opening 62 and/or the apertures 65 as the propeller 5 rotates. The water can then pass out of the guard 6 through the end 63 and/or the apertures proximate the end 63.

Thus, the guard 6, in addition to protecting the rider from inadvertent contact with the propeller 5, also permits water ingress and egress therethrough for contacting the propeller 5. The guard 5 can be formed of any appropriate material, for example, but not limited to, metals, plastics, composites, and related materials. The apertures 65 can be formed in any configuration, including rectangular, as illustrated, cylindrical, irregularly shaped, and other such configurations. The material of the guard and the configuration of the apertures 65 are not critical to the operation of the motorized surfboard device 1, as long as their function is not adversely influenced.

Further, the guard 6 of the motorized surfboard device 1, as embodied by the invention, can comprise apertures 65, formed by at least one of holes, screens, meshes, slots, and other such appropriate aperture-forming structures. Furthermore, the guard 6 can comprise a screen-like element 66 (FIG. 5) that encloses at least a portion of the motive device 3, inclusive of the propeller 5. For example, and in no way limiting of the invention, the screen-like element 66 may totally encircle the motive device 3 of the motorized surfboard device 1 to provide enhanced safety to a rider of the motorized surfboard device 1.

Of course, the configuration of the propeller 5, as embodied by the invention and discussed above, does not necessitate incorporation of a guard 6 or 66, as explained herein. The configuration of the propeller 5, as embodied by the invention, as the propeller 5 is not seen to provide dangerous and cutting surfaces that may harm a rider if the rider should fall off of the motorized surfboard device 1. The use of a guard 6 or 66, as embodied by the invention, provides further and enhanced safety to a rider of the motorized surfboard device 1 if the rider should fall off of the motorized surfboard device 1.

The motorized surfboard device 1 also comprises at least one control apparatus 40 and 400. The control apparatus 40 is disposed on the surfboard 2 of the motorized surfboard device 1 proximate a foot guard area of the motorized surfboard device 1 so as to operable by a rider of the motorized surfboard device 1. The rider of the motorized surfboard device 1 can operate the control apparatus 40 of the motorized surfboard device 1 to control the motive device 3 of the motorized surfboard device 1, as illustrated in phantom, as connection 44. The type of connection 44 can be any appropriate connection 44 that transmits signals from the control apparatus 40 to the motive device 3 to control and operate the motive device 3 of the motorized surfboard device 1, as embodied by the invention. The exact nature and structure of the connection 44 does not impart any criticality to the motorized surfboard device 1, as embodied by the invention, as long as the connection 44 can transmit signals from the control apparatus 40 to the motive device 3. The rider of the motorized surfboard device 1 can control the control apparatus 40 through one or both of their feet. The control apparatus 40 can comprise one or more switches, and while the illustrated embodiment of FIG. 1, illustrates 3 switches.

The control apparatus 40 is illustrated in FIG. 1 proximate a front or leading portion of the surfboard 2, however, this positioning is merely exemplary of positioning of the control apparatus 40, as embodied by the invention. For example, although not illustrated the control apparatus 40 can be disposed at a midsection of the surfboard 2 of the motorized surfboard device 1. Further, the control apparatus 40 may be positioned at the rear end of the surfboard 2 disposed near the motive device 3 of the motorized surfboard device 1. Furthermore, the control apparatus 40 can be disposed all along the length of the surfboard 2 so that the rider can have full access to the control apparatus 40 along the surfboard's length.

The control apparatus 40 controls the motive device 3. The control apparatus 40 can turn the motive device 3, which is inclusive of the motor 4, on and off. For example, however not intending to limit the invention in any manner, the control apparatus 40 can include a pressure actuated switch that can turn the motor 4 on or off depending on the pressure exerted by a rider. For example, the control apparatus 40 can turn off the motive device 3 if pressure is off the respective switch of the control apparatus 40 for a set period of time, for example two seconds. This period of time is desirable as a rider of the motorized surfboard device 1 may switch lead foot on the surfboard 2 and not always be in contact with the surfboard 2 at all times.

The control apparatus 40 may also comprise other switches 41 that control speed of the motor 4 and thus rotational speed of the propeller 5. The switch that controls the speed of the motor 4 can comprise any appropriate switch through which the user may increase or decrease the motor 4 and thus the rotational speed of the propeller 5. Accordingly, the rider can increase or decrease the speed of the motorized surfboard device 1 through simple actuation of the control apparatus 40 by the rider's foot.

Further, the control apparatus 40 may also include a switch that controls a stop apparatus 30 for the motorized surfboard device 1. The stop apparatus 30 comprises a retractable element 31 that can be positioned inside a recess 32 of the surfboard 2. A mechanism 33 is disposed within the recess 32 in order to extend and retract the stop apparatus 30 from the recess 32. The retractable element 31 of the stop apparatus 30 can be extended out of the recess 32 in order to stop forward movement of the motorized surfboard device 1. Further, the retractable element 31 of the stop apparatus 30 can be extended out of the recess 32 in order to turn the forward movement of the motorized surfboard device 1.

The control apparatus 400 is disposed on the surfboard 2 of the motorized surfboard device 1 on sides of the surfboard 2 of the motorized surfboard device 1 so as to operable by hands of a rider of the motorized surfboard device 1. The rider of the motorized surfboard device 1 can operate the control apparatus 400 of the motorized surfboard device 1 to control the motive device 3 of the motorized surfboard device 1, as illustrated in phantom, as connection 44. The type of connection 44 can be any appropriate connection 44 that transmits signals from the control apparatus 400 to the motive device 3 to control and operate the motive device 3 of the motorized surfboard device 1, as embodied by the invention. The exact nature and structure of the connection 44 does not impart any criticality to the motorized surfboard device 1, as embodied by the invention, as long as the connection 44 can transmit signals from the control apparatus 400 to the motive device 3.

The rider of the motorized surfboard device 1 can control the control apparatus 400 through one or both of their hands when in a prone or kneeling position so their hands are at sides of the surfboard 2. The control apparatus 400 can comprise one or more switches, and while the illustrated embodiment of FIG. 1, illustrates 3 switches.

The control apparatus 400 is illustrated in FIG. 1 proximate a front or leading side portion of the surfboard 2, however, this positioning is merely exemplary of positioning of the control apparatus 400, as embodied by the invention. For example, although not illustrated the control apparatus 400 can be disposed at a midsection of the surfboard 2 of the motorized surfboard device 1. Further, the control apparatus 400 can be disposed all along the length of the surfboard 2 so that the rider can have full access to the control apparatus 400 by hand along the surfboard's length.

The control apparatus 400 controls the motive device 3. The control apparatus 400 can turn the motive device 3, which is inclusive of the motor 4, on and off. For example, however not intending to limit the invention in any manner, the control apparatus 400 can include a pressure actuated switch that can turn the motor 4 on or off depending on the pressure exerted by a rider. For example, the control apparatus 400 can turn off the motive device 3 if pressure is off the respective switch of the control apparatus 400 for a set period of time, for example two seconds.

The control apparatus 400 may also comprise other switches that control speed of the motor 4 and thus rotational speed of the propeller 5. The switch that controls the speed of the motor 4 can comprise any appropriate switch through which the user may increase or decrease the motor 4 and thus the rotational speed of the propeller 5. Accordingly, the rider can increase or decrease the speed of the motorized surfboard device 1 through simple actuation of the control apparatus 400 by the rider's hand.

Further, the control apparatus 400 may also include a switch that controls a stop apparatus 30 for the motorized surfboard device 1. The stop apparatus 30 comprises a retractable element 31 that can be positioned inside a recess 32 of the surfboard 2. A mechanism 33 is disposed within the recess 32 in order to extend and retract the stop apparatus 30 from the recess 32. The retractable element 31 of the stop apparatus 30 can be extended out of the recess 32 in order to stop forward movement of the motorized surfboard device 1. Further, the retractable element 31 of the stop apparatus 30 can be extended out of the recess 32 in order to turn the forward movement of the motorized surfboard device 1.

The control apparatus 400 is operable with a time delay to maintain the switches and associated apparatuses in an on position. Thus, a user of the motorized surfboard device 1 can move into a stand position from a kneeling or reclined position. Therefore, a user can stand and ride a wave without losing power from the motorized surfboard device 1. The time delay may be provided by any appropriate time delay mechanism, for example, and in no way limiting of the invention, mechanical time delay mechanisms, analog delay mechanisms, digital delay mechanisms, combinations thereof, and other delay mechanisms.

As illustrated in the figures, the retractable element 31 comprises a slanted element, however this configuration is merely exemplary and is not intended to limit the invention in any manner. Further, the retractable element 31 may be formed of any suitable and appropriate material, including, but not limited to, metal, plastics, flexible and resilient materials, composites, and combinations thereof. The exact material of the retractable element 31 is not material to the motorized surfboard device 1, as embodied by the invention, as long as its functionality is not impaired by the choice of material.

The retractable element 31 of the stop apparatus 30 can be extended out of the recess 32 when the motor 4 is turned off, when the rider is not in contact with the control apparatus 40 for a period of time, and combinations thereof (hereinafter referred to as "conditions"). The stop apparatus 30 is thus connected to the motor 4 and the control apparatus 40 by stop apparatus connections 35 so that signals representative of the motor 4 being turned off, the rider not being in contact with the control apparatus 40 for a period of time, and combinations thereof can be transmitted to the mechanism 33 to retract and extend the retractable element 31 of the stop apparatus 30. The retractable element 31, as embodied by the invention, can comprise a generally solid element that acts to resist forward movement of the motorized surfboard device 1 under the conditions as explained above.

Figure 6:
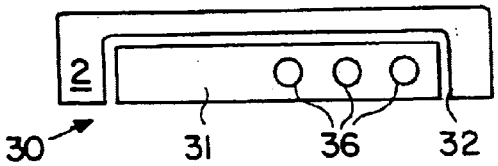
FIGS. 6–8 are illustrations of stop apparatuses and retractable elements, as embodied by the invention.
Figure 7:
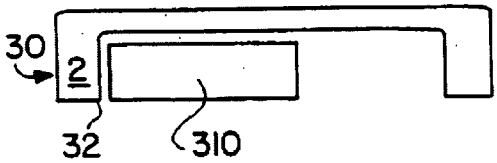
Figure 8:
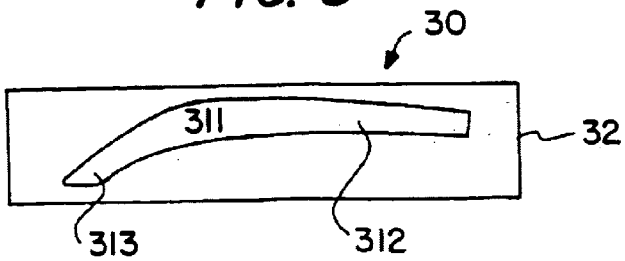

Other configurations of the retractable element 31 of the stop apparatus 30 are illustrated in detail in FIGS. 6–8. FIGS. 6 and 7 are cross-sectional views of the stop apparatus 30 and retractable element 31, while FIG. 8 is a bottom view of the surfboard 2 illustrating another configuration of the stop apparatus 30 and retractable element 31. The retractable element 31, as embodied by the invention and illustrated in FIG. 6, can comprise a generally solid element that acts to resist comprises at least one and possibly a plurality of apertures 36 that act to provide increased fluid resistance at one side and lesser fluid resistance at the other side of the retractable element 31. Thus, the stop apparatus 30 and the retractable element 31 will cause forward motion of the motorized surfboard device 1 to halt so that surfboard 2 will not travel away from a fallen rider under the conditions. Further, the retractable element 31 will turn the motorized surfboard device 1 so the surfboard 2 will tend to travel back towards the fallen rider under the conditions.

FIG. 7 illustrates another configuration of the retractable element 310 in the stop apparatus 30, as embodied by the invention. The retractable element 310 of FIG. 7 comprises a retractable element 310 that extends only partially across the length of the recess 32. Thus, the retractable element 310 will tend to stop forward motion of the motorized surfboard device 1 under the conditions. Also, the retractable element 310 will tend to turn the surfboard 2 of the motorized surfboard device 1 by virtue of the differential fluid resistance imparted by the retractable element 310 under the conditions.

FIG. 8 illustrates another configuration of a retractable element 311, as embodied by the invention. The retractable element 311 of FIG. 8 comprises an elongated retractable element 311 that is defined by a straight section 312 and a curved section 313. The configuration of the retractable element 311 will tend to stop forward motion of the motorized surfboard device 1 under the conditions. Also, the retractable element 311 will tend to turn the surfboard 2 of the motorized surfboard device 1 by virtue of the differential fluid resistance imparted by the retractable element 311 under the conditions.

The motorized surfboard device 1 also comprises at least two fins 20 (also known in the art as "rudders"). The fins 20 are common to surfboards to provide stability and control during riding waves. Although, the fins 20 are illustrated as being secured to the surfboard 2 in a rigid manner, the fins 20 may be rotatably secured on the bottom of the surfboard 2. Further, cables or other means can be connected to the fins 20 for providing enhanced control of the motorized surfboard device 1.

Figure 5:
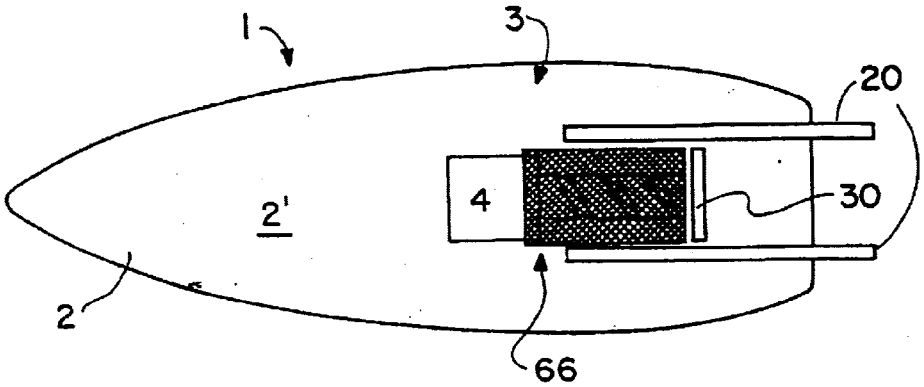
FIG. 5 is another bottom view of a motorized surfboard device, as embodied by the invention, that illustrates a further safety device for the screw propeller.

The at least two fins 20 are disposed on the underside of the surfboard 2 and extend along the propeller 5 of the motive device 3 (FIGS. 2 and 5). The fins 20 thus act as means to protect a fallen surfboard rider from inadvertent contact with the propeller 5. The fins 20 do not impair the ingress of water into the motive device 3.

Figure 9:
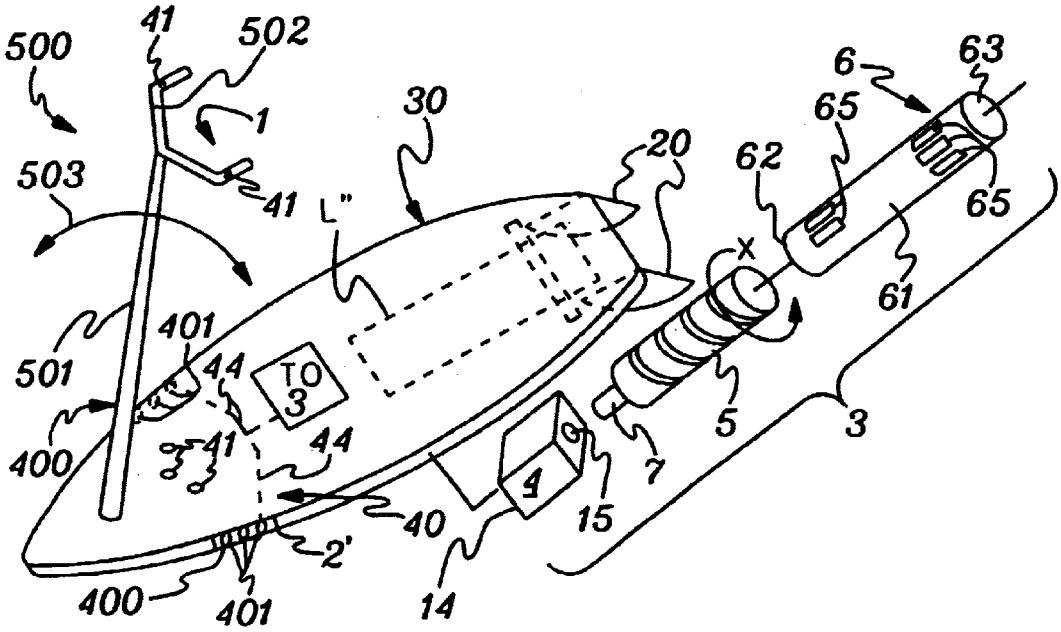
FIG. 9 is a schematic and exploded illustration of a further motorized surfboard device, as embodied by the invention.

FIG. 9 is a schematic and exploded illustration of a further motorized surfboard device, as embodied by the invention. In FIG. 9, like elements are designated by like reference characters. For ease of description, the differing features of the further motorized surfboard device, of FIG. 9, will be described hereinafter. The remainder of the features are as described above.

In FIG. 9, the motorized surfboard device 100 also comprises a control apparatus 40, as in the above embodiments. The control apparatus 40, of the motorized surfboard device 100, as embodied by the invention, comprises at least one of a foot-controlled switch, a hand-operated and controlled steering column 500, and a hand controlled (on the motorized surfboard device) switch. The foot-controlled switch and a hand controlled switch are as described above, and for a further description, reference should be made to the above portions of the specification. The hand-operated and controlled steering column 500 comprises an elongated element 501 that extends from the motorized surfboard device 100 and a handle bar element 502 that extends from the elongated element 501 of the hand-operated and controlled steering column 500.

The elongated element 501 can be pivoted from the motorized surfboard device 100 in the direction of arrow 503 so as to be accessible by operators of all heights. By the pivoting in the direction of arrow 503 the handle bar element 502 also moves in the direction of arrow 503. Further, the hand-operated and controlled steering column 500 can be elongated to be adjustable in length. For example, and in no way limiting of the invention, the elongated element 501 can comprise a telescoping configuration.

The pivoting of hand-operated and controlled steering column 500 can permit the hand-operated and controlled steering column 500 to stored essentially flat against the surface of the hand-operated and controlled steering column 500. Further, the hand-operated and controlled steering column 500 can be removable from the motorized surfboard device 100, as embodied by the invention, wherein a user of the motorized surfboard device 100 can be in the form of a surfboard, on which a user of the motorized surfboard device 100 can stand and steer with their feet. Additionally, by removing the hand-operated and controlled steering column 500, the user of the motorized surfboard device 100, as embodied by the invention, can lie flat on the motorized surfboard device 100 and ride.

The handle bar element 502 can comprise switches 41 that control speed of the motor 4 and thus rotational speed of the propeller 5. Further, the handle bar element 502 comprises controls, for example switches similar to switches 41, for controlling the motive device 3. The handle bar element 502 can be used to turn motorized surfboard device 100, control the motive device 3, which is inclusive of the motor 4, can turn the motorized surfboard device 100 on and off. For example, however not intending to limit the invention in any manner, the handle bar element 502 can include a pressure actuated switch that can turn the motor 4 on or off depending on the pressure exerted by a rider.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other component of the described and illustrated embodiments.

What is claimed:

1. A motorized surfboard device that can be ridden by a rider, the motorized surfboard device comprising:

a surfboard comprising an underside surface and a top side surface;

a motive device mounted on the underside surface of the surfboard, the motive device comprising a motor and a rotatable propeller, the motor being operably connected to the rotatable propeller for rotating the rotatable propeller, the rotatable propeller comprising:

a cylindrical body with a surface configuration, the surface configuration comprising at least one groove in a surface of the rotatable propeller body, wherein the at least one grove defines raised ridges between the at least one groove, the edges of the at least one grooves being rounded, the at least one groove comprising a depth; and a control apparatus comprising at least one of a foot-controlled switch, a hand-operated and controlled steering column, and a hand controlled switch, the control apparatus controlling at least one of on/off operation of the motor and variable speed of the motor, wherein a rider of the motorized surfboard device can ride the surfboard without waves.

2. A motorized surfboard device according to claim 1, the surfboard of the motorized surfboard device further comprising at least two fin that provides stability to the motorized surfboard device, the at least two fins being disposed on opposing sides of the motive device and extend along the propeller to sandwich the motive device and propeller therebetween, wherein the at least two fins can prevent inadvertent contact of a rider with the propeller.

3. A motorized surfboard device according to claim 1, the motorized surfboard device further comprising a guard, the guard comprising a body that encircles at least a portion of the propeller to cover the propeller, wherein the guard permits water to contact the propeller while protecting a rider from inadvertent contact with the propeller.

4. A motorized surfboard device according to claim 3, wherein the guard further comprises a generally cylindrical body, the generally cylindrical body having ends, the cylindrical body being open at both ends, the cylindrical body further comprising at least one aperture along the cylindrical body, the apertures being disposed along the cylindrical body so that water may enter and exit the cylindrical body by virtue of the rotation of the rotatable propeller, wherein water may be pulled into the grooves of the propeller through at least one of openings and apertures as the rotatable propeller rotates, and the water can then be moved by the rotatable propeller and pass out of the guard through at least one of the end and the apertures.

5. A motorized surfboard device according to claim 4, wherein the at least one grooves comprises edges at the cylindrical body surface, the edges being rounded.

6. A motorized surfboard device according to claim 3, wherein the guard further comprises a screen that encircles the propeller of the motive device.

7. A motorized surfboard device according to claim 1, the surfboard of the motorized surfboard device further comprising depression on the underside surface of the surfboard, the motive device being disposed in the depression.

8. A motorized surfboard device according to claim 1, wherein the control apparatus of the motorized surfboard device comprises a switch that controls the speed of the motor and a switch that senses when a rider of the motorized surfboard device is no in contact with the top side surface of the surfboard for a period of time that generally indicates that the rider has fallen off of the surfboard.

9. A motorized surfboard device according to claim 1, the motorized surfboard device further comprising stop apparatus, the stop apparatus comprises a retractable element disposed in a recess in the underside surface of the surfboard, the stop apparatus further comprising a mechanism that is disposed within the recess to extend and retract the stop apparatus from the recess, wherein the retractable element can be extended out of the recess for at least one of stopping forward movement of the motorized surfboard device and turn the forward movement of the motorized surfboard device.

10. A motorized surfboard device according to claim 9, wherein the retractable element of the stop apparatus can be extended out of the recess when at least one of: the motor of the motive device of the motorized surfboard device is turned off; the rider is not in contact with the control apparatus for a period of time; and combinations thereof.

11. A motorized surfboard device according to claim 9, wherein the retractable element of the stop apparatus comprises at least one of a generally solid element; a generally solid element that comprises at least one aperture that provides increased fluid resistance at one side of the retractable element and lesser fluid resistance at the other side of the retractable element; a retractable element that extends only partially across the recess; and an elongated retractable element that comprises by a straight section and a curved section.

12. A motorized surfboard device that can be ridden by a rider, the motorized surfboard device comprising:

a surfboard comprising an underside surface and a top side surface;

a motive device mounted on the underside surface of the surfboard, the motive device comprising a motor and a rotatable propeller, the motor being operably connected to the rotatable propeller for rotating the rotatable propeller, the rotatable propeller comprising:

a cylindrical body with a surface configuration, the surface configuration comprising at least one groove in a surface of the rotatable propeller body, wherein the at least one groove defines raised ridges between the at least one groove, the edges of the grooves being rounded, the at least one groove comprising a depth;

a guard, the guard comprising a body that encircles at least a portion of the propeller to cover the propeller, wherein the guard permits water to contact the propeller while protecting a rider from inadvertent contact with the propeller; and a control apparatus comprising at least one of a foot-controlled switch, a hand-operated and controlled steering column, and a hand controlled switch, the control apparatus controlling at least one of on/off operation of the motor and variable speed of the motor, wherein a rider of the motorized surfboard device can ride the surfboard without waves.

13. A motorized surfboard device according to claim 12, wherein the guard further comprises a generally cylindrical body, the generally cylindrical body having ends, the cylindrical body being open at both ends, the cylindrical body further comprising at least one aperture along the cylindrical body, the apertures being disposed along the cylindrical body so that water may enter and exit the cylindrical body by virtue of the rotation of the rotatable propeller, wherein water may be pulled into the grooves of the propeller through at least one of openings and apertures as the rotatable propeller rotates, and the water can then be moved by the rotatable propeller and pass out of the guard through at least one of the end and the apertures.

14. A motorized surfboard device according to claim 13, wherein the at least one grooves comprises edges at the cylindrical body surface, the edges being rounded.

15. A motorized surfboard device according to claim 12, the surfboard of the motorized surfboard device further comprising depression on the underside surface of the surfboard, the motive device being disposed in the depression.

16. A motorized surfboard device according to claim 12, wherein the control apparatus of the motorized surfboard device comprises a switch that controls the speed of the motor and a switch that senses when a rider of the motorized surfboard device is no in contact with the top side surface of the surfboard for a period of time that generally indicates that the rider has fallen off of the surfboard.

17. A motorized surfboard device according to claim 12, the motorized surfboard device further comprising stop apparatus, the stop apparatus comprises a retractable element disposed in a recess in the underside surface of the surfboard, the stop apparatus further comprising a mechanism that is disposed within the recess to extend and retract the stop apparatus from the recess, wherein the retractable element can be extended out of the recess for at least one of stopping forward movement of the motorized surfboard device and turn the forward movement of the motorized surfboard device.

18. A motorized surfboard device according to claim 17, wherein the retractable element of the stop apparatus can be extended out of the recess when at least one of: the motor of the motive device of the motorized surfboard device is turned off; the rider is not in contact with the control apparatus for a period of time; and combinations thereof.

19. A motorized surfboard device according to claim 17, wherein the retractable element of the stop apparatus comprises at least one of a generally solid element; a generally solid element that comprises at least one aperture that provides increased fluid resistance at one side of the retractable element and lesser fluid resistance at the other side of the retractable element; a retractable element that extends only partially across the recess; and an elongated retractable element that comprises by a straight section and a curved section.

20. A motorized surfboard device according to claim 1, wherein the control comprises a hand-operated and controlled steering column, the hand-operated and controlled steering column comprises an elongated element that extends from the motorized surfboard device and a handle bar element, the handle bar element extends from the elongated element of the hand-operated and controlled steering column.

* * * * *